US011896097B2

(12) United States Patent
Xie

(10) Patent No.: US 11,896,097 B2
(45) Date of Patent: Feb. 13, 2024

(54) CANTILEVERED UMBRELLA

(71) Applicant: ZHEJIANG YOTRIO GROUP CO., LTD., Zhejiang (CN)

(72) Inventor: Jianqiang Xie, Linhai (CN)

(73) Assignee: Yotrio Group Co., Ltd., Zhejiang (CN)

( * ) Notice: Subject to any disclaimer, the term of this patent is extended or adjusted under 35 U.S.C. 154(b) by 0 days.

(21) Appl. No.: 17/330,072

(22) PCT Filed: May 7, 2020

(86) PCT No.: PCT/CN2020/088997
§ 371 (c)(1),
(2) Date: May 25, 2021

(87) PCT Pub. No.: WO2020/228585
PCT Pub. Date: Nov. 19, 2020

(65) Prior Publication Data

US 2022/0079308 A1 Mar. 17, 2022

(30) Foreign Application Priority Data

May 10, 2019 (CN) ..... 201920671057.2

(51) Int. Cl.
*A45B 25/14* (2006.01)
*A45B 23/00* (2006.01)

(52) U.S. Cl.
CPC ..... *A45B 25/14* (2013.01); *A45B 23/00* (2013.01); *A45B 2023/005* (2013.01); *A45B 2023/0012* (2013.01)

(58) Field of Classification Search
CPC ..... A45B 2023/0081
See application file for complete search history.

(56) References Cited

U.S. PATENT DOCUMENTS 6,588,438 B1 * 7/2003 Steiner ..... A45B 25/06 135/21
9,289,038 B2 * 3/2016 Ma ..... A45B 25/08
9,930,942 B2 * 4/2018 Ma ..... A45B 23/00
(Continued)

FOREIGN PATENT DOCUMENTS

DE 102008034985 A1 * 2/2010 ..... A45B 17/00
DE 102011009758 B3 * 7/2012 ..... A45B 17/00
FR 2992834 A1 * 1/2014 ..... A45B 17/00

*Primary Examiner* — Noah Chandler Hawk
(74) *Attorney, Agent, or Firm* — Jingming (James) Cai; SAC Attorneys LLP

(57) ABSTRACT

A cantilevered umbrella, including a stand column, an umbrella tent and a cantilever is disclosed. One end of the cantilever is connected to the stand column through a shell in a rotating mode, and other end is connected with the umbrella tent. Rotation of the cantilever drives the umbrella tent to rotate, with opening of the umbrella tent rotating to a certain angle in a relatively horizontal direction. The cantilevered umbrella further includes a positioning part. One end of the positioning part is connected to the cantilever in a fixed mode, and other end extends into the shell. A first positioning portion is arranged on an inner wall of the shell, a second positioning portion is arranged on the positioning part, and the first and second positioning portions limit the cantilever in a circumferential rotating range through coordination.

9 Claims, 15 Drawing Sheets

(56) References Cited

U.S. PATENT DOCUMENTS

| | | | | |
|---|---|---|---|---|
| 2003/0010366 | A1* | 1/2003 | Glatz | A45B 25/14<br>135/21 |
| 2006/0243311 | A1* | 11/2006 | Glatz | A45B 23/00<br>135/120.2 |

* cited by examiner

CANTILEVERED UMBRELLA

CROSS-REFERENCE TO RELATED APPLICATIONS

This application is a national stage application of the Patent Cooperation Treaty (PCT) international application titled "Cantilevered Umbrella", international application number PCT/CN2020/088997, filed in the Chinese Patent Office on May 7, 2020, which claims priority to and the benefit of the non-provisional patent application titled "Cantilevered Umbrella", non-provisional patent application number CN201920671057.2, filed in the Chinese Patent Office on May 10, 2019. The specifications of the above referenced patent applications are incorporated herein by reference in their entirety.

FIELD OF THE INVENTION

The utility model relates to the technical field of furniture, in particular to a cantilevered umbrella.

BACKGROUND

The cantilevered umbrella is provided with a stand column, a cantilever and an umbrella tent. The umbrella tent is suspended through the cantilever, and the opening can rotate with the rotation of the cantilever. A mechanism controlling the opening and closing of umbrella tent is also arranged on the stand column. However, the existing cantilevered umbrella is only provided with indication arrows and numbers that indicate the rotating angle of the cantilever, but without the structure for positioning the rotating range of the cantilever. Therefore, if the umbrella tent rotates to a large elevation, the umbrella may tilt due to large external force (such as wind power), leading to the damage and injury of surrounding people and articles.

SUMMARY OF THE INVENTION

The utility model overcomes at least one of the above shortcomings and provides a cantilevered umbrella.

The technical scheme for the utility model is as follows:

A cantilevered umbrella comprises: a stand column, an umbrella tent and a cantilever. One end of the cantilever is connected with the stand column through a shell in a rotating mode, also referred to as a rotating configuration, and the other end is connected with the umbrella tent. The rotation of cantilever can drive the umbrella tent to rotate, with the opening of umbrella tent rotating to a certain angle in a relatively horizontal direction; the cantilevered umbrella also comprises a positioning part. One end of the positioning part is connected with the cantilever in a fixed mode, also referred to as a fixed configuration, and the other end extends into the shell. A first positioning portion is arranged on the inner wall of the shell, a second positioning portion is arranged on the positioning part, and the first positioning portion and the second positioning portion limit the cantilever in the circumferential rotating range through coordination.

In an embodiment of the utility model, the first positioning portion is a positioning groove formed circumferentially along the inner wall of the shell. The end portion of the second positioning portion is inserted in the positioning groove. The movement range of the second positioning portion is limited between the both ends of the positioning groove.

In an embodiment of the utility model, the first positioning portion is at least two positioning bosses arranged circumferentially along the inner wall of the shell and form a limit space. The end portion of the second positioning portion is inserted in the limit space. The movement range of the second positioning portion is limited between the two adjacent positioning bosses.

In an embodiment of the utility model, the second positioning portion is a positioning bolt penetrating through the positioning part.

In an embodiment of the utility model, the second positioning portion is the positioning bulge formed on the surface of the positioning part.

The embodiment in the utility model also comprises a positioning display part fixed at one end of the cantilever. One end of the positioning display part extends into the shell, and the other end exposes from the shell. A first positioning display block is arranged at one end, exposing from the shell, of the positioning display part. Two second positioning display blocks are arranged at the end of the shell at intervals. The first positioning display block is located between the two second positioning display blocks and moves in the same range as the movable range of the second positioning portion in the shell.

When rotating the cantilever, the second positioning portion moves in the shell. The first positioning display block moves between the two second positioning display blocks, and the movement position of the second positioning portion can be judged according to the movement position of the first positioning display block.

In an embodiment of the utility model, the positioning part is provided with multiple flanges and connected with the cantilever through rivets.

In an embodiment of the utility model, the shell comprises a sliding block shell and a cantilever shell. The sliding block shell is arranged on the stand column in a sliding mode, also referred to as a sliding configuration. The cantilever shell is installed at one end of the sliding block shell in a pivoted mode, also referred to as a pivoted configuration. The first positioning portion is arranged on the cantilever shell, and the positioning part is installed in the cantilever shell.

In an embodiment of the utility model, an indication identification for indicating the rotating direction of the cantilever is arranged on the outer surface of the cantilever shell and comprises indication arrows and/or words.

An embodiment of the utility model also comprises a sliding block positioning mechanism arranged in the sliding block shell, used for fixing the sliding block shell in any position of the stand column and comprises a positioning rack, a positioning block and a handle; the positioning rack is arranged on one side of the stand column. The positioning block is installed in the sliding block shell in a movable mode, also referred to as movable configuration, in the direction near or far away from the positioning rack. One end of the handle is installed in the sliding block shell in a rotating mode, also referred to as rotating configuration, and the other end is connected with the positioning block to drive it for movement; fixing teeth are arranged at one end, facing toward the positioning rack, of the positioning block, and meshed with the contacting surface of positioning rack to fix the positioning block; the number of the fixing teeth is more than two; The sliding block positioning mechanism also comprises an elastic reset part connected with the shell and the positioning block so that the positioning block can move toward the positioning rack.

Compared with the prior art, the advantageous effect of the utility model is: the utility model can limit the umbrella tent from rotating to a large elevation through the positioning part, so as to avoid tilting under the large external force. In addition, the positioning part is simple in structure, convenient to install, firm and favorable for prolonging the service life of the umbrella.

DETAILED DESCRIPTION OF THE INVENTION

The utility model is described in detail in combination with the attached FIGS. 1-15.

Figure 1:
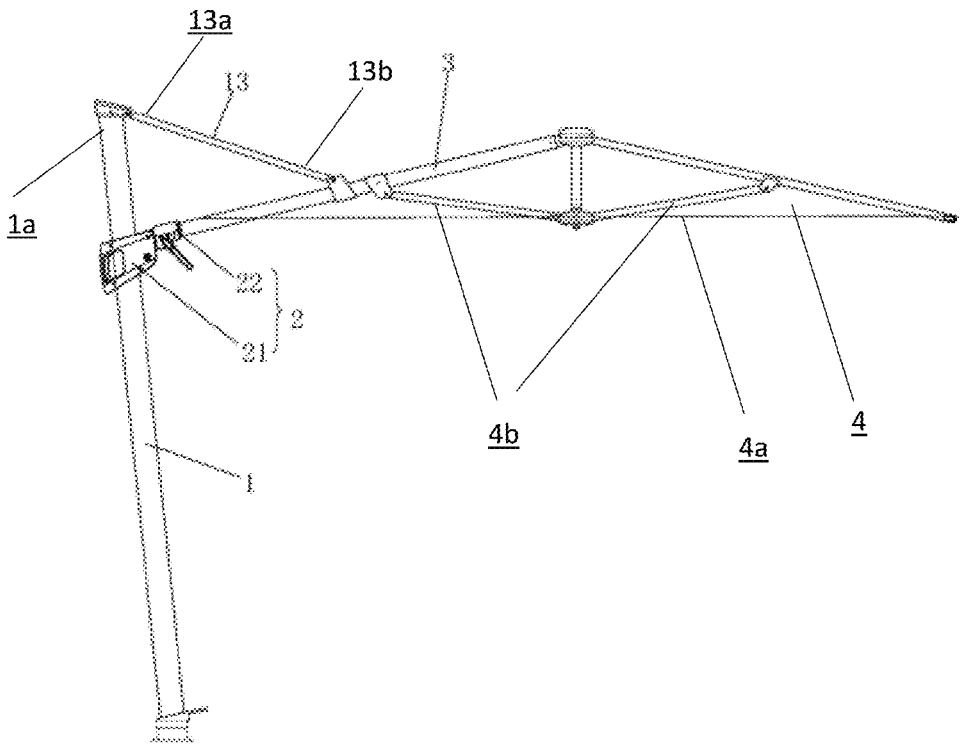
FIG. 1 is the three-dimensional structural diagram of the cantilevered umbrella in an embodiment of the utility model.

According to FIGS. 1-8, the utility model provides a cantilevered umbrella which comprises: stand column 1, umbrella tent 4 and cantilever 3. One end of the cantilever 3 is connected with the stand column 1 through shell 2 in a rotating mode, also referred to as a rotating configuration, and the other end is connected with the umbrella tent 4. The rotation of cantilever 3 can drive the umbrella tent 4 to rotate, with the opening 4*a*, as shown in FIG. 1, of umbrella tent 4 rotating to a certain angle in a relatively horizontal direction.

Figure 3:
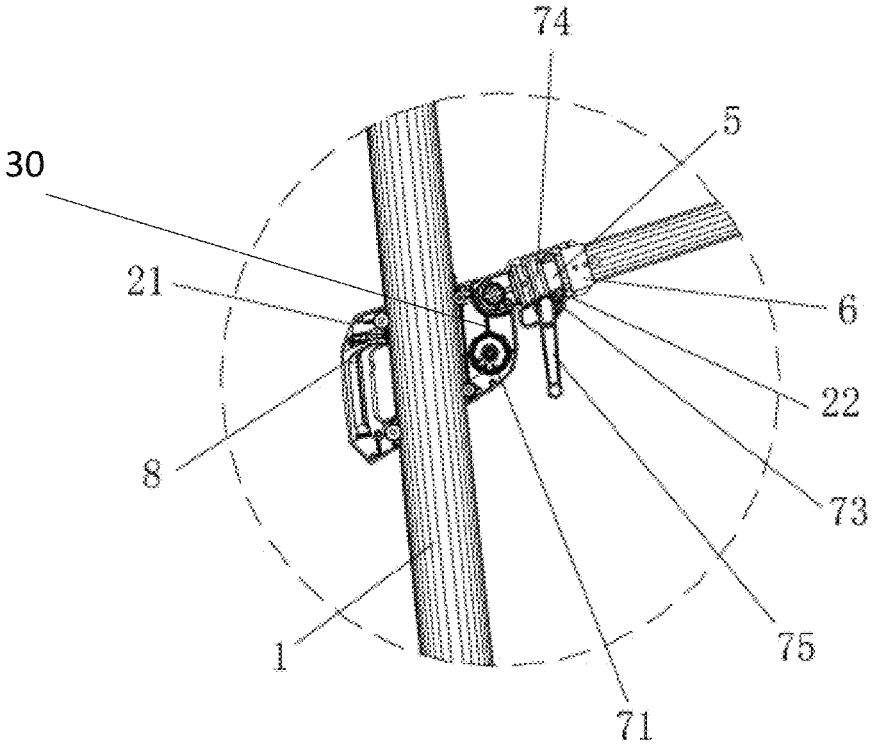
FIG. 3 is a partial enlarged drawing of section A in FIG. 2.
Figure 7:
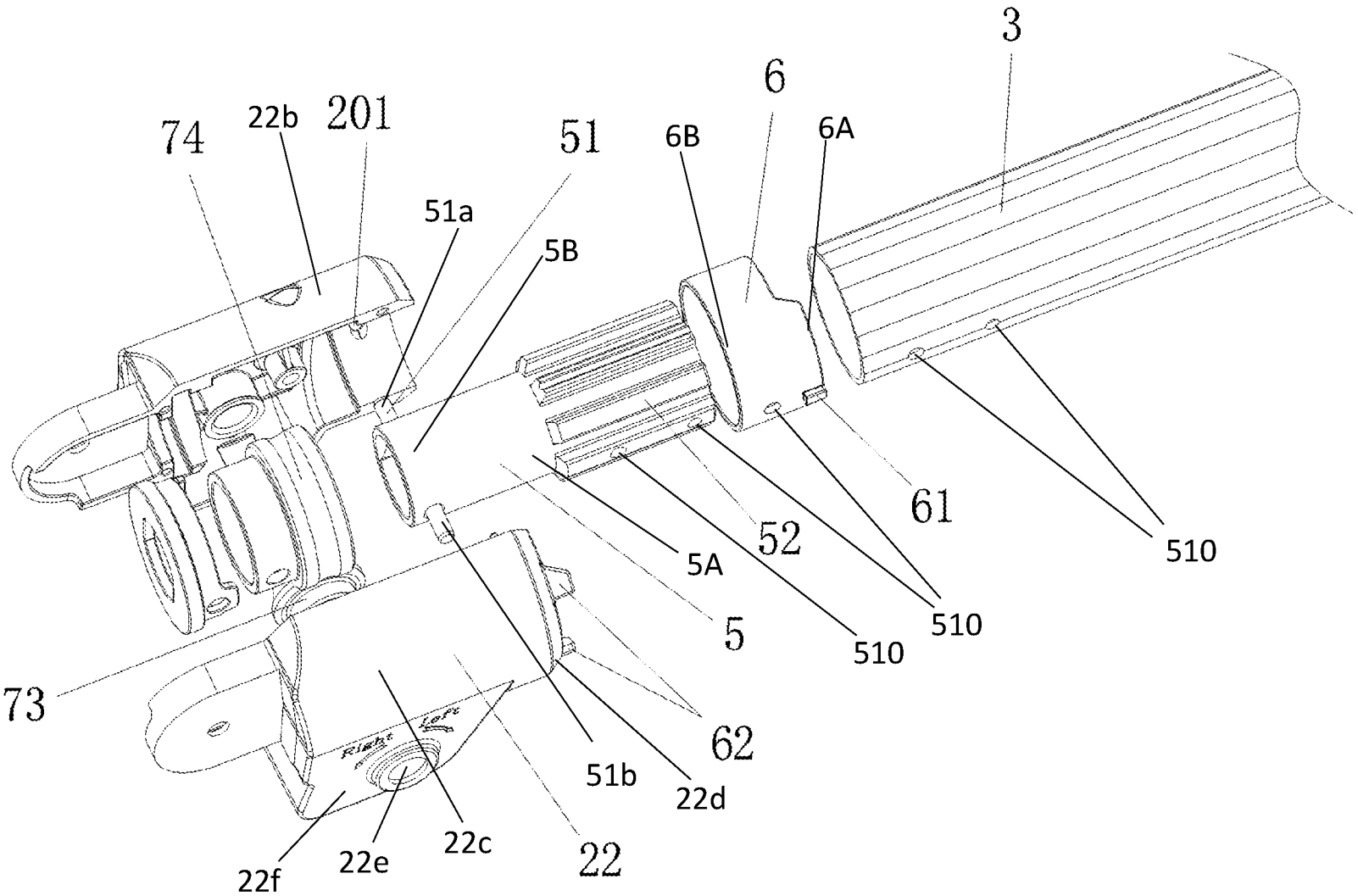
FIG. 7 is the explosive view of local structure of the cantilevered umbrella in an embodiment of the utility model.
Figure 8:
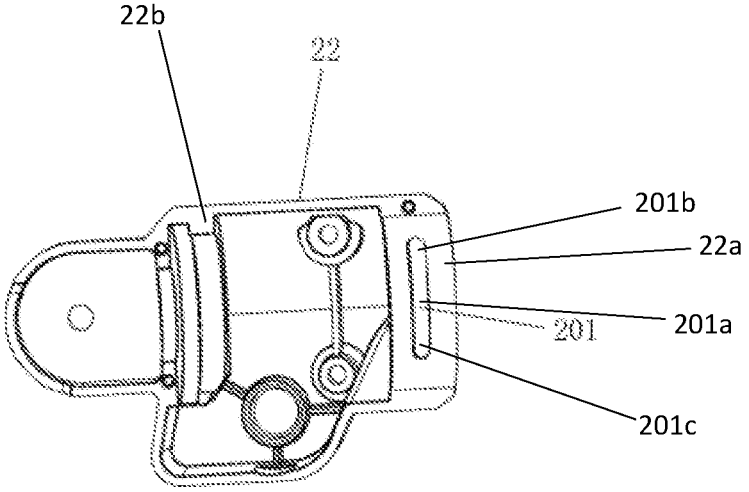
FIG. 8 is the structural diagram of cantilever shell of the cantilevered umbrella in an embodiment of the utility model.

The cantilevered umbrella also comprises positioning part 5, as shown in FIG. 3. As shown in FIG. 7, one end 5A of the positioning part 5 is connected with the cantilever 3 in a fixed mode, also referred to as a fixed configuration, and the other end 5B extends into the shell 2. As illustrated in FIGS. 7 and 8, a first positioning portion 201 is arranged on the inner wall of the shell 2, a second positioning portion 51 is arranged on the positioning part 5, and the first positioning portion 201 and the second positioning portion 51 limit the cantilever 3 in the circumferential rotating range through coordination.

In the utility model, when rotating the cantilever 3, the opening 4*a* of the umbrella tent 4 rotates and drives the positioning part 5 and the second positioning portion 51 to rotate together. The limit to the second positioning portion 51 by the first positioning portion 201 can limit the rotating range of the cantilever 3, so as to limit the rotation direction of the opening 4*a* of the umbrella tent 4. The positioning part 5 can prevent the umbrella tent 4 from rotating to a large elevation, so as to avoid tilting of the umbrella due to large external force (wind power).

Further, the shell 2 comprises a sliding block shell 21 and a cantilever shell 22. The sliding block shell 21 is arranged on the stand column 1 in a sliding mode, also referred to as a sliding configuration. The cantilever shell 22 is installed at one end of the sliding block shell 21 in a pivoted mode, also referred to as a pivoted configuration. The first positioning portion 201 is arranged on the cantilever shell 22, and the second positioning part 5 is installed in the cantilever shell 22. The above structure enables the cantilever 3 to retract relative to the stand column 1 for storage; in addition, the cantilever 3 can extend to a certain included angle relative to the stand column 1, so as to provide a better supporting structure for the expansion of the umbrella tent 4.

As shown in FIG. 2-8 of an embodiment, the first positioning portion 201 is a positioning groove 201*a* formed circumferentially along the inner wall 22*a* of the cantilever shell 22. An end portion, for example, 51*a*, of the second positioning portion 51 is inserted in the positioning groove 201*a* on a first portion 22*b* of the cantilever shell 22. Another end portion 51*b* of the second positioning portion 51 is inserted in the positioning groove (not shown) on a second portion 22*c* of the cantilever shell 22. The movement range of the second positioning portion 51 is limited between both ends 51*a* and 51*b* of the positioning groove 201*a*. Each of the ends 51*a* and 51*b* travel between a first end 201*b* and a second end 201*c* of their respective grooves 201*a*.

Figure 9:
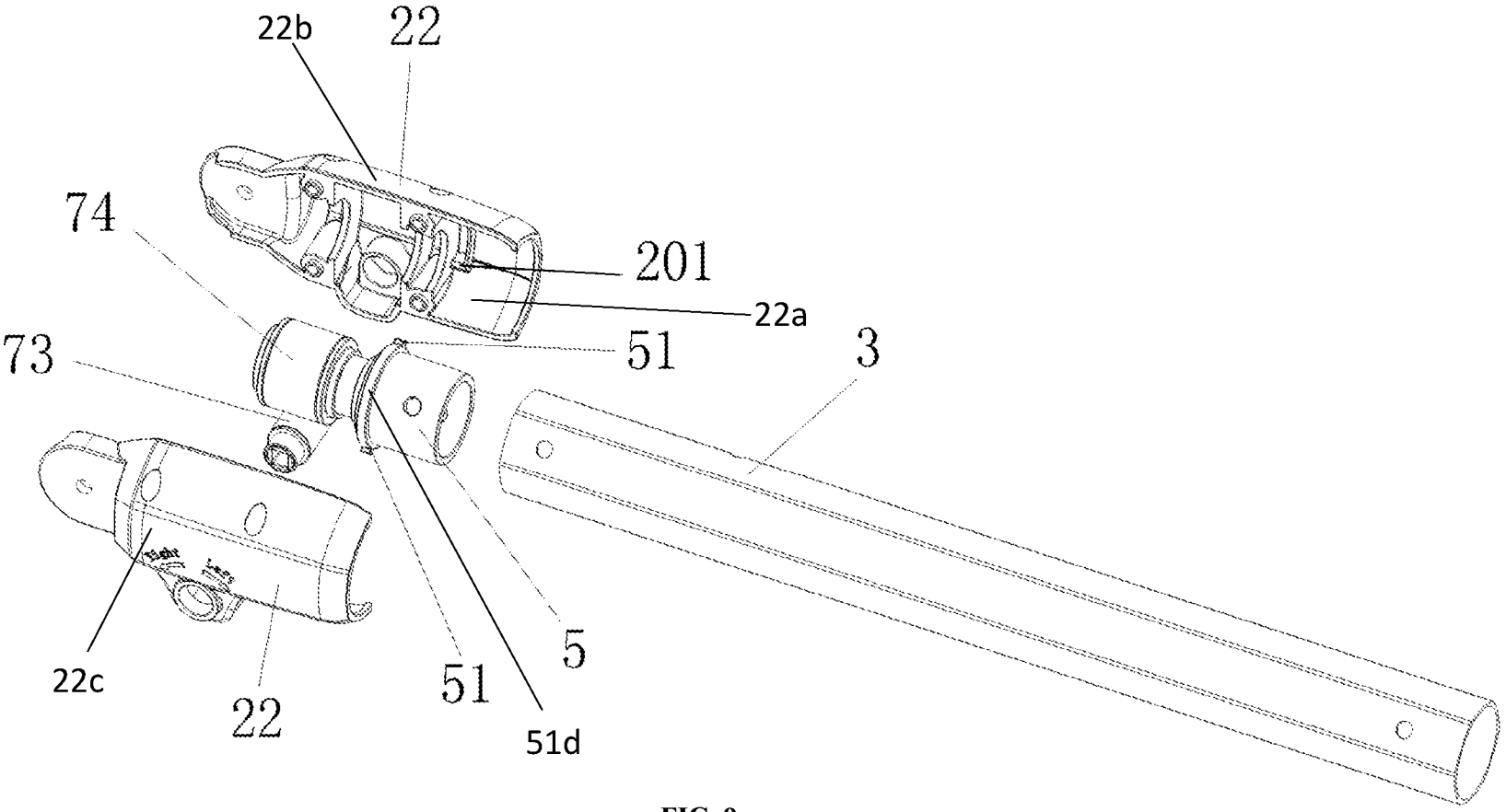
FIG. 9 is the explosive view of local structure of the cantilevered umbrella in other embodiment of the utility model.
Figure 10:
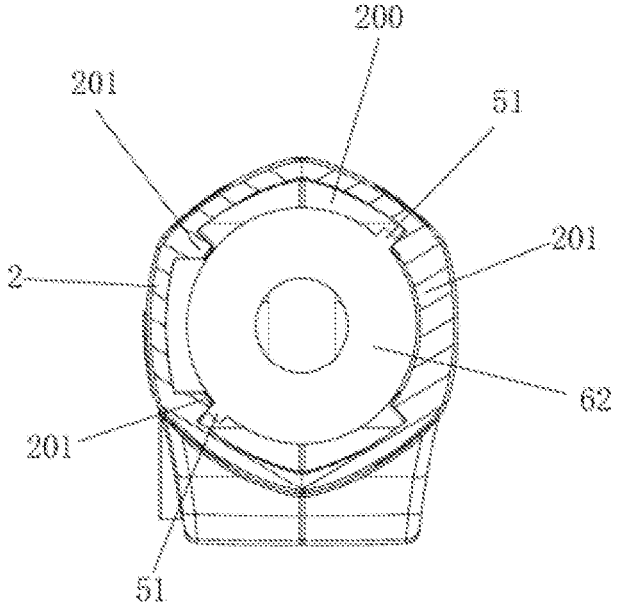
FIG. 10 is the section view of the positioning part of the cantilevered umbrella as shown in FIG. 9.
Figure 11:
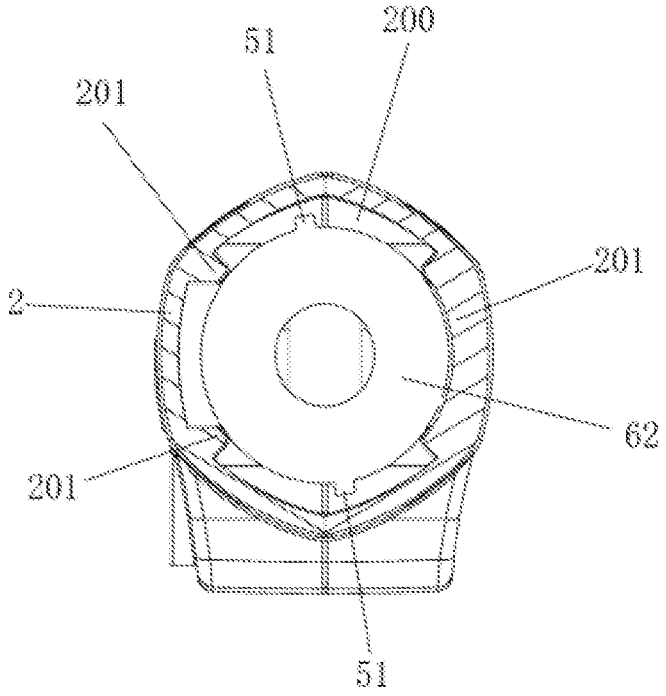
FIG. 11 is the section view when the cantilever rotates to another angle as shown in FIG. 10.

As shown in FIGS. 9-11 of the other embodiment, the first positioning portion 201 is at least two positioning bosses 201 arranged circumferentially along the inner wall 22*a* of the cantilever shell 22. A limit space 200 is formed between at least two positioning bosses 201. The end portion 51*d* of the second positioning portion 51 is inserted in the limit space 200, as shown in FIG. 10, and the movement range of the second positioning portion 51 is limited between the two adjacent positioning bosses 201.

As shown in FIGS. 7 and 8 of an embodiment, the second positioning portion 51 is a positioning bolt penetrating through the positioning part 5. In the embodiment, the positioning bolt is inserted in the positioning groove 201*a* and moves in a limited range i.e., between the first end 201*b* and the second end 201*c* of the respective grooves 201*a*.

As shown in FIGS. 9-11 of the other embodiment, the second positioning portion 51 is the positioning bulge formed on the surface of the positioning part 5. As shown in FIG. 10, the positioning bulge 51 is close to the side of the positioning bosses 201. At this moment, the cantilever 3 cannot rotate clockwise continuously but only rotates reversely till the positioning bulge 51 is sheltered by the positioning boss 201 on the other side.

Further, as shown in FIG. 7, the cantilevered umbrella also comprises a positioning display part 6 fixed at one end of the cantilever 3. As shown in FIG. 7, the positioning bolt 51 penetrates through the positioning display part 6 and fix it on the cantilever 3. One end 6A of the positioning display part 6 extends from the cantilever shell 22, and another end 6B extends into the cantilever shell 22. A first positioning display block 61 is arranged at one end 6A, exposing from the cantilever shell 22, of the positioning display part 6. Two second positioning display blocks 62 are arranged at an end portion 22*d* of the cantilever shell 22 with an interval between the display blocks 62. The end portion 22*d* of the cantilever shell 22 is proximal to the positioning part 5, as shown in in FIG. 7. The first positioning display block 61 is located between the two second positioning display blocks 62 and moves in the same range as the movable range of the second positioning portion 51 in the cantilever shell 22, that is, the movable range of the first positioning display block 61 between the two second positioning display blocks 62 is the same as that of the positioning bolt in the positioning groove 201*a*.

When rotating the cantilever 3, the second positioning portion 51 moves in the cantilever shell 22 (that is, the positioning bolt moves in the positioning groove). The first positioning display block 61 moves between the two second positioning display blocks 62, and the movement position of the second positioning portion 51 in the cantilever shell 22 can be judged according to the movement position of the first positioning display block 61 (i.e., the movement position of the positioning bolt in the positioning groove 201*a*).

In the embodiment, there are first positioning display block 61 and the second positioning display block 62 that are visible. The position of the positioning bolt in the positioning groove can be judged according to the movement position of the first positioning display block 61, which prevents the continuous movement of the positioning bolt (i.e., rotation of the cantilever 3) after reaching the end portion i.e., 201*b* or 201*c* of the positioning groove 201*a*, and avoids internal structure damage of the cantilever shell 22 due to large force.

The positioning part 5, the positioning display part 6 and the cantilever 3 are provided with bolt holes 510, as shown in FIG. 7. The positioning bolt can be inserted into the bolt hole 510 for connection, fixing the positioning part 5, the positioning display part 6 and the cantilever 3, and facilitating the installation.

Further, the positioning part 5 is provided with multiple flanges 52 to reduce its weight, save the materials and lower the cost. Further, the positioning part 5 is connected with the cantilever 3 in a fixed mode, also referred to as a fixed configuration, through rivets (not shown), so as to ensure the firm connection.

Further, as shown in FIG. 1, the cantilevered umbrella also comprises a slanting rod 13. One end 13*a* of the slanting rod 13 is connected with the upper end 1*a* of the stand column 1 in a pivoted mode, also referred to as a pivoted configuration, the other end 13*b* of the slanting rod 13 is connected with the cantilever 3 in the pivoted mode, so as to suspend and support the cantilever 3.

The umbrella tent 4 comprises umbrella bones 4*b* and a canopy. It will not be explained here since the structure is the same as the prior art.

The cantilevered umbrella also comprises an open-close mechanism and a steering mechanism of the umbrella tent.

The open-close mechanism is arranged in the sliding block shell 21 for controlling the opening and closing of the umbrella tent 4. The open-close mechanism comprises an open-close rotating wheel 71, shown in FIGS. 3 and 4, and a tensioning rope 30, shown in FIG. 3. The open-close rotating wheel 71 is installed in the sliding block shell 21 in a rotating mode, also referred to as a rotating configuration. One end of the tensioning rope winds the open-close rotating wheel 71, and the other end penetrates through the cantilever 3 to connect with the umbrella tent 4. By rotating the open-close rotating wheel 71 and retracting/releasing the tensioning rope, the umbrella tent 4 can be opened and closed. One end 71*a*, shown in FIG. 4 of the open-close rotating wheel 71 exposes from the sliding block shell 21 to enable the jiggle bar 75 to be connect with the open-close rotating wheel 71, so that the jiggle bar 75 can control the rotation of the open-close rotating wheel 71.

The steering mechanism is arranged in the cantilever shell 22 for controlling the rotation of the cantilever 3 and the opening direction of the umbrella tent 4. The steering mechanism comprises a worm 73 and a worm gear 74, as shown in FIG. 7. The worm 73 is installed in the cantilever shell 22 in a rotating mode, also referred to as a rotating configuration. One end 73*a* of the worm 73 is exposed through a hole 22*e* on the side 22*f* of the cantilever shell 22, and this hole 22*e* is used for connecting the jiggle bar 75 to the worm 73 so that the jiggle bar 75 can control the worm 73 to rotate. The worm gear 74 is installed outside the positioning part 5 in a sleeved mode, connected with the positioning part 5 in a fixed mode, meshed with the worm 73 and drives the worm gear 74 to rotate. The sleeved mode and the fixed mode are also referred to as a sleeved configuration and a fixed configuration, respectively. When the worm 73 is connected with the jiggle bar 75, the rotation of jiggle bar 75 drives the worm 73 to rotate, the worm 73 drives the worm gear 74 to rotate, the worm gear 74 drives the positioning part 5 to rotate and the positioning part 5 drives the cantilever 3 to rotate, so that the opening 4*a* of the umbrella tent 4 can rotate.

The cantilevered umbrella also comprises a jiggle bar 75 connected with the open-close rotating wheel 71 or the worm 73 in a detachable mode also referred to as a detachable configuration. When connecting with the open-close rotating wheel 71 or the worm 73, the jiggle bar 75 can control the opening and closing of the umbrella or the rotating direction of the opening of the umbrella tent 4.

Figure 4:
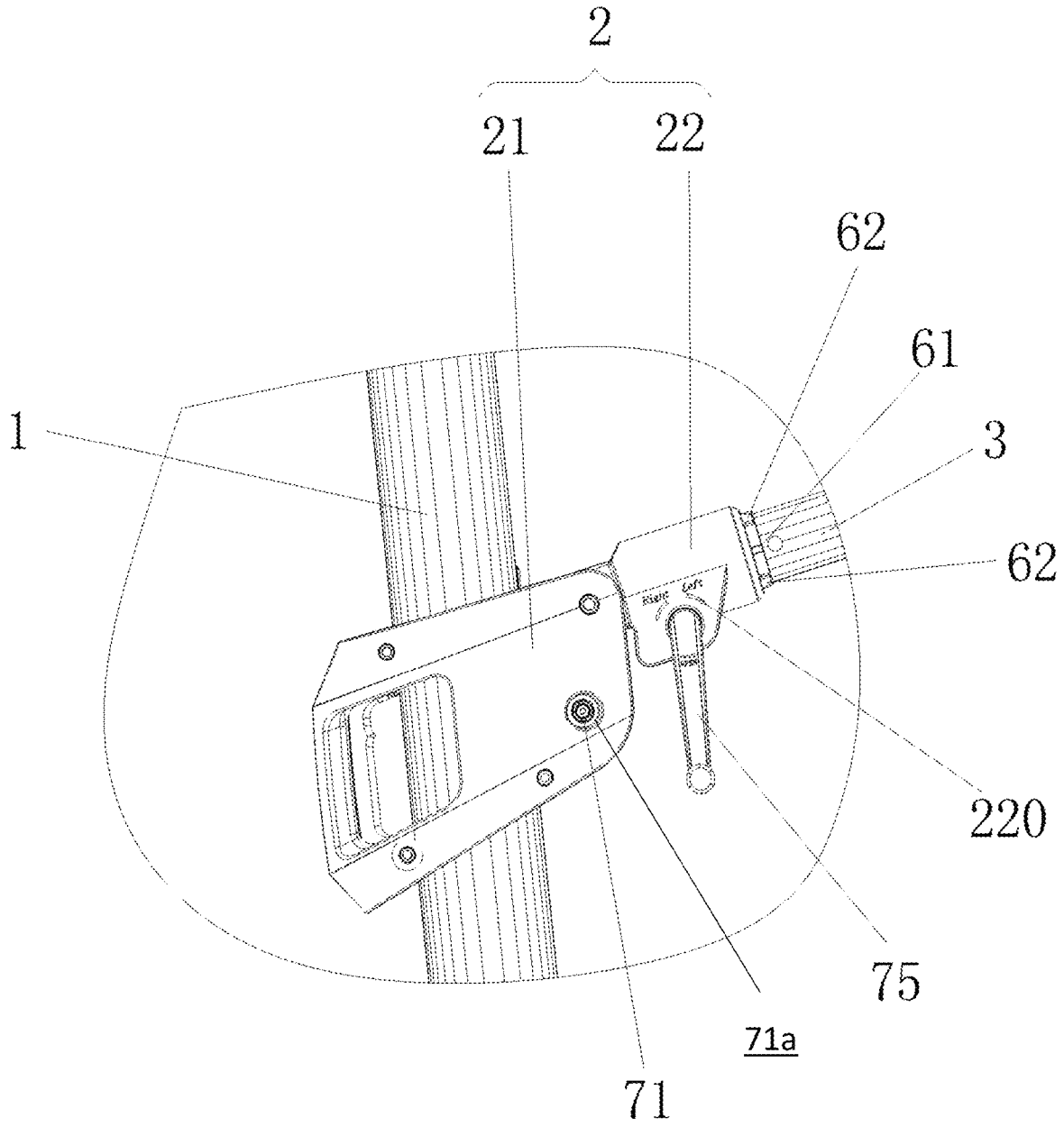
FIG. 4 is the three-dimensional structural diagram of the partial section of the cantilevered umbrella in an embodiment of the utility model.
Figure 5:
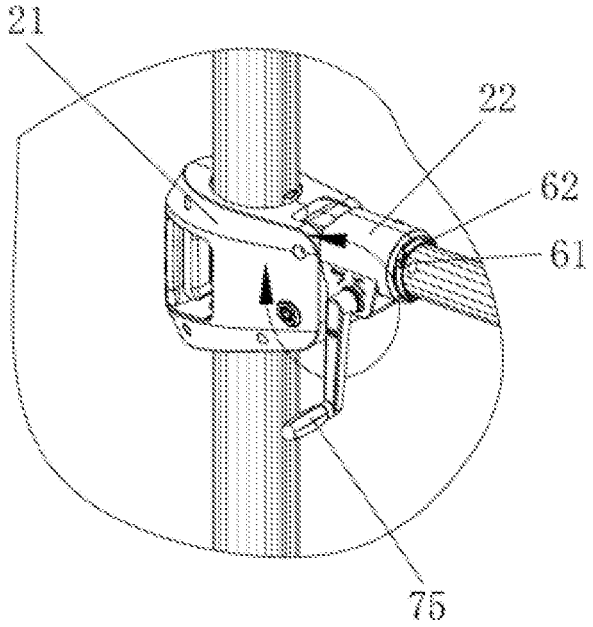
FIG. 5 is the structural diagram when the cantilever rotates to the maximum angle clockwise as shown in FIG. 4.
Figure 6:
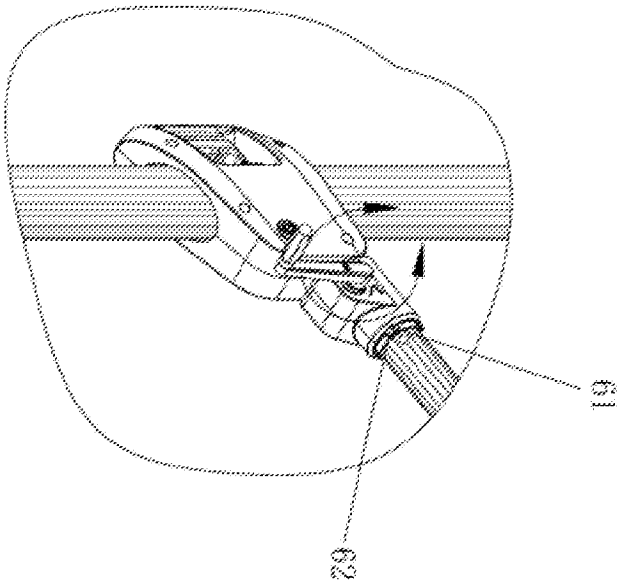
FIG. 6 is the structural diagram when the cantilever rotates to the maximum angle anticlockwise as shown in FIG. 4.

As shown in FIG. 4, an indication identification 220 that indicates the rotating direction of the opening 4*a* of the umbrella tent 4 is arranged on the outer surface of the cantilever shell 22, and comprises the indication arrows and/or words to indicate the user to rotate the jiggle bar 75 to the direction that the opening 4*a* of the umbrella tent 4 should face toward.

Figure 2:
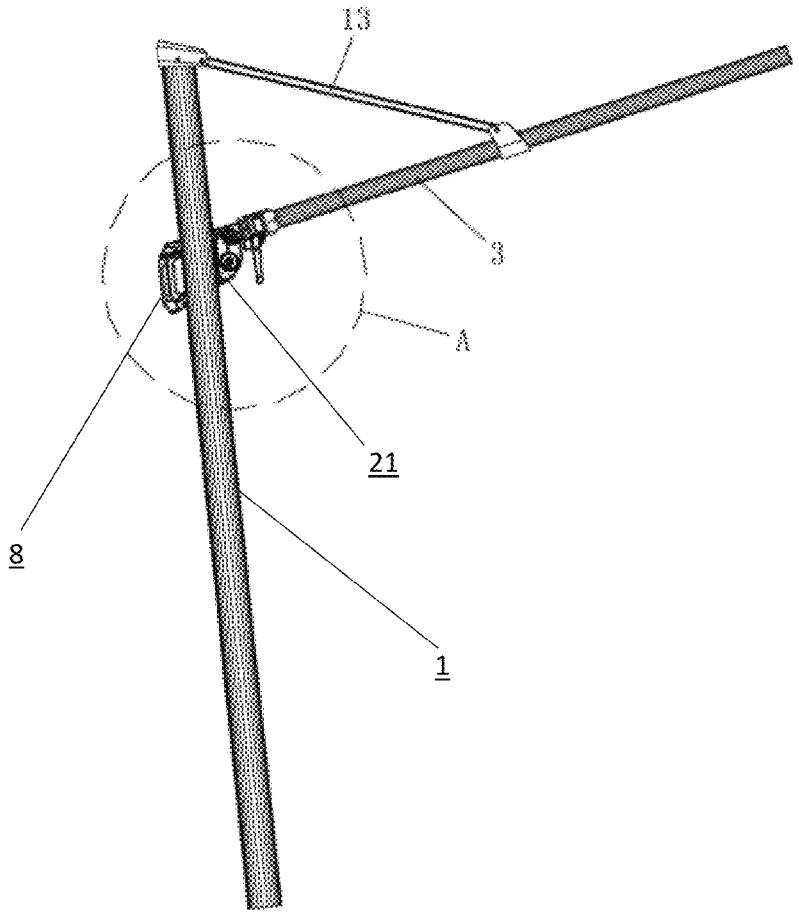
FIG. 2 is the structural diagram of the partial section of the cantilevered umbrella in an embodiment of the utility model.

As shown in FIG. 2, the cantilevered umbrella also comprises the sliding block positioning mechanism 8 arranged in the sliding block shell 21. The sliding block positioning mechanism 8 is used for fixing the sliding block shell 21 in any position of the stand column 1, so that the cantilever 3 can extend by different included angles relative to the stand column 1 and adjust the height of the umbrella tent 4.

Figure 12:
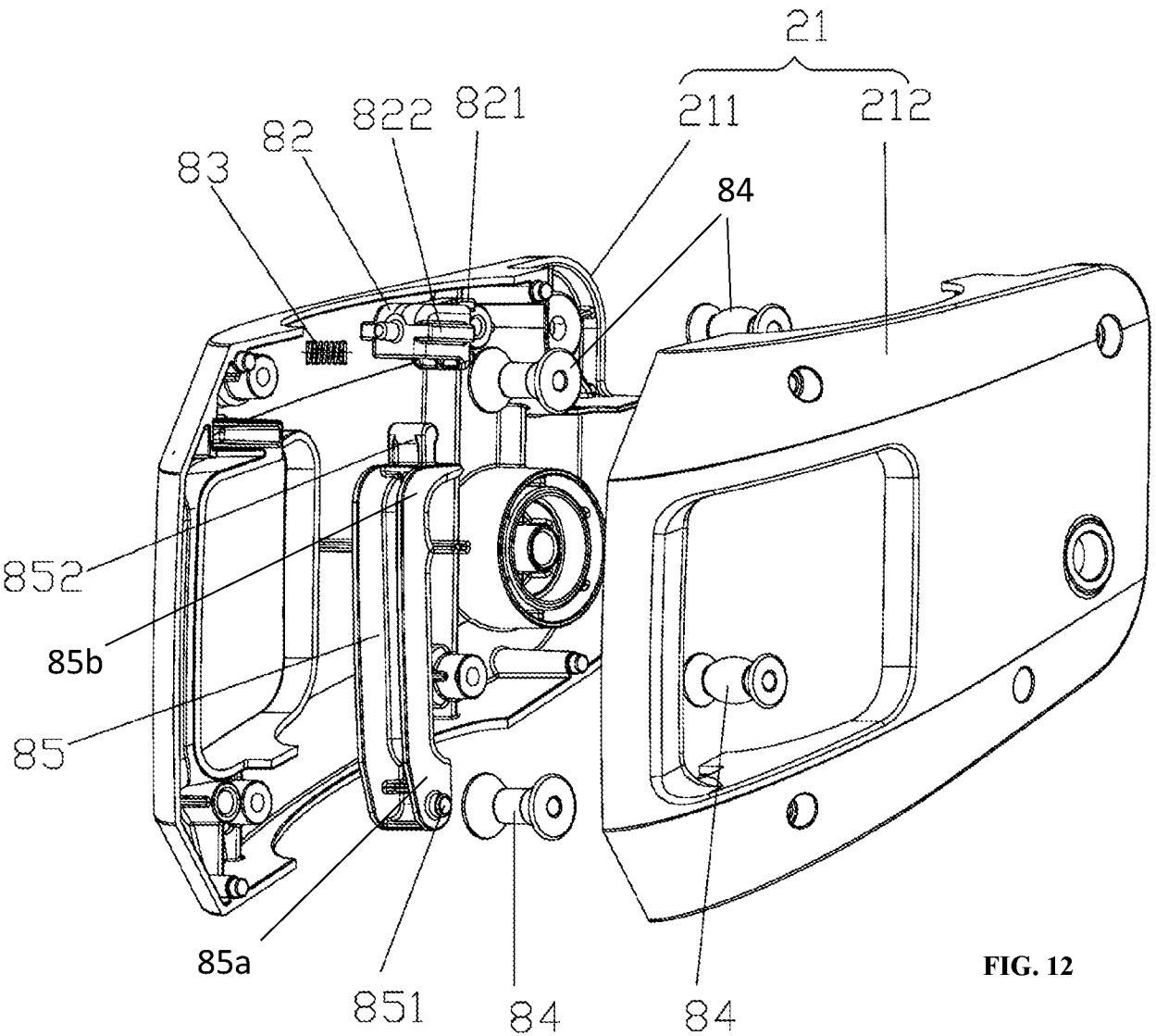
FIG. 12 is the explosive view of sliding block positioning mechanism of the cantilevered umbrella in an embodiment of the utility model.
Figure 13:
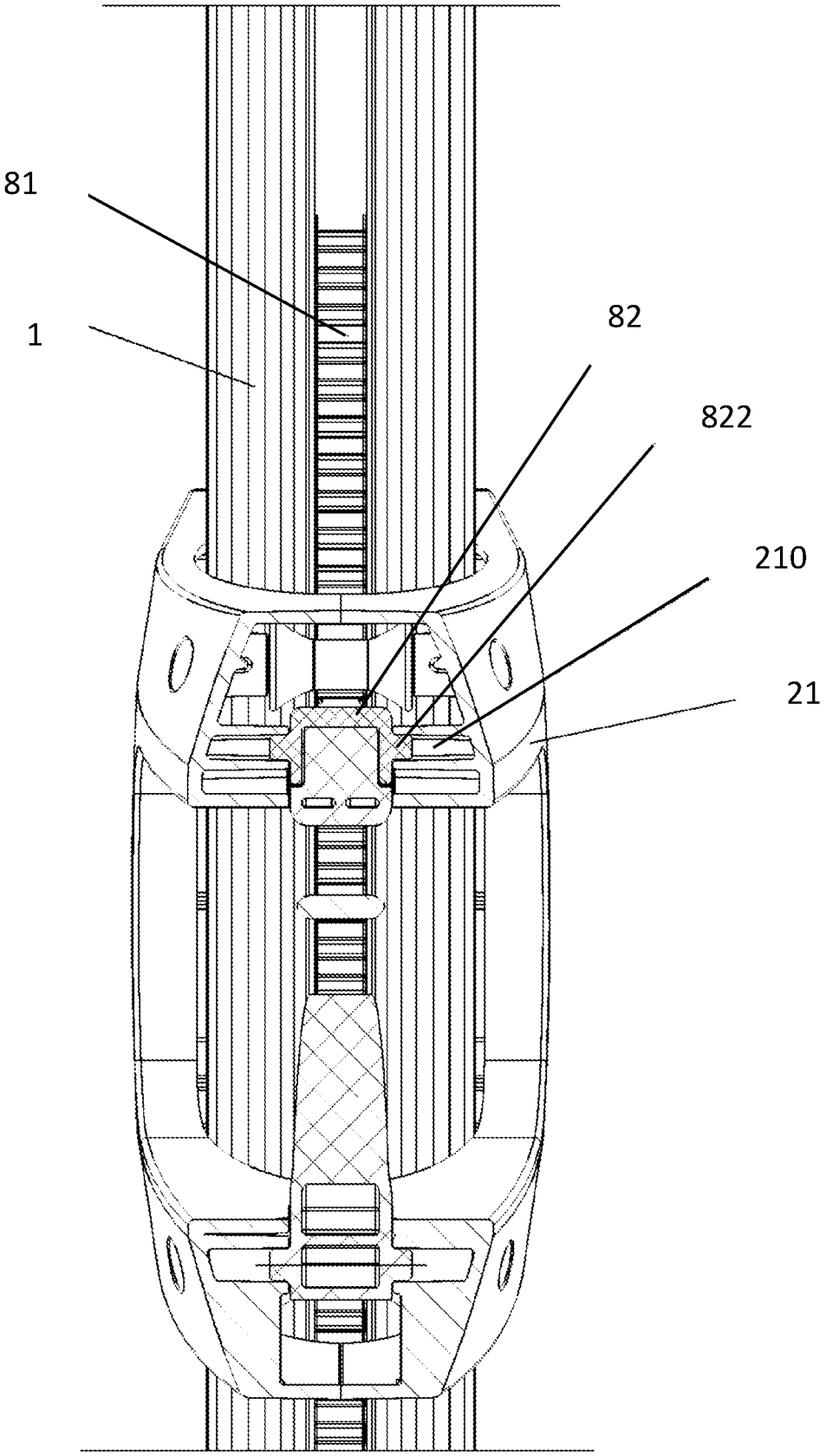
FIG. 13 is the local section view of the sliding block positioning mechanism of the cantilevered umbrella in an embodiment of the utility model.

According to FIGS. 12-15, in an embodiment, the sliding block positioning mechanism 8 comprises a positioning rack 81, as shown in FIG. 13, a positioning block 82, and a handle 85. The positioning rack 81 is arranged on the side of the stand column 1. The positioning block 82 is installed in the sliding block shell 21 in the direction near or far away from the positioning rack 81 in a movable mode, also referred to as a movable configuration. Fixing tooth 821 is arranged at one end 82*a* of the positioning block 82, facing toward the positioning rack 81 and meshed with the contacting surface of the positioning rack 81 to fix the positioning block 82. One end 85*a* of the handle 85 is installed on the sliding block shell 21 in a rotating mode, also referred to as a rotating configuration, and the other end 85*b* of the handle 85 is connected with the positioning block 82 to drive it to move. The number of the fixing tooth 821 is more than two, which ensures enough supporting strength, supports the cantilever 3 and keeps the umbrella tent 4 connected with the cantilever 3 stable.

In the embodiment, the rotation of the handle 85 can drive the positioning block 82 to move and keep close or far away from the positioning rack 81. When the positioning block 82 is close to the rack and the fixing tooth 821 is meshed with the contacting surface of the positioning rack 81, the positioning block 82 is fixed in a certain position of the stand column 1, so that the sliding block positioning mechanism 8 and the sliding block shell 21 can be fixed in a certain position of the stand column 1; when the positioning block 82 is far away from the rack, the fixing tooth 821 is separated from the positioning rack 81, and the sliding block shell 21 can move along the stand column 1 and adjust the position. Since the fixing tooth 821 is meshed with the positioning rack 81 through contacting surface and the number of the fixing tooth 821 is more than two, the structure stress points can disperse onto the positioning rack 81, which ensures appropriate supporting strength and stable installation of the umbrella tent 4, and the umbrella tent 4 cannot be damaged easily by the wind.

As shown in FIG. 12, the sliding block shell 21 comprises a first sliding block shell 211 and a second sliding block shell 212 which are coordinated to form a shell structure. Further, the first sliding block shell 211 and the second sliding block shell 212 are fixed together through screws for facilitating installation.

Figure 14:
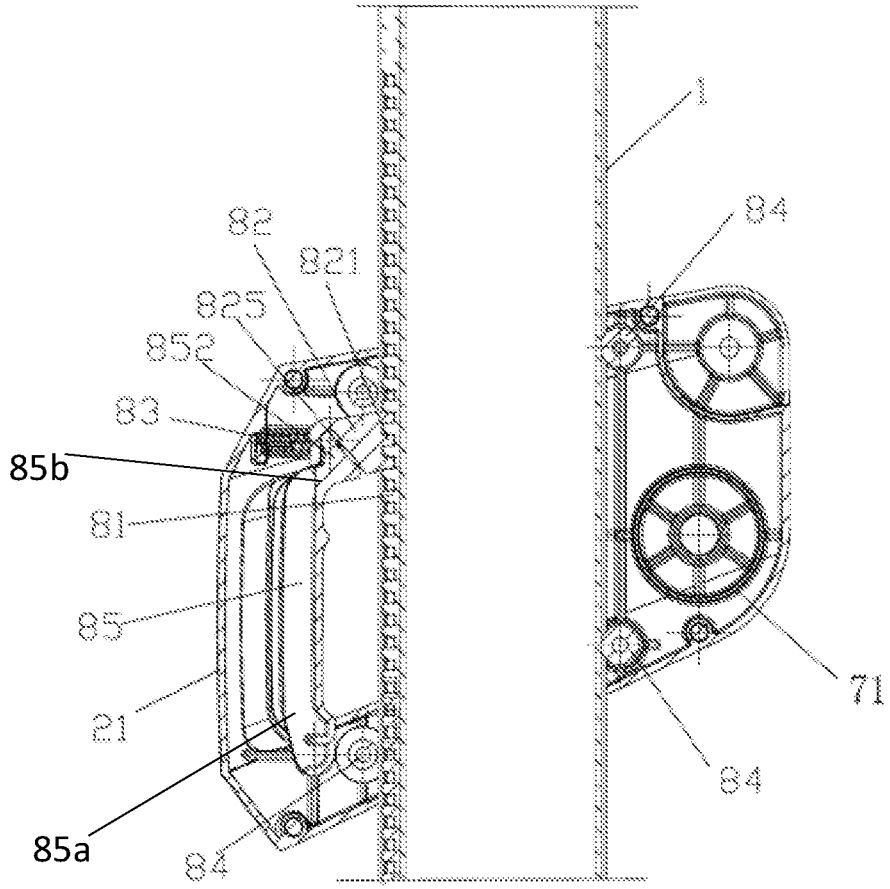
FIG. 14 is the assembly diagram of sliding block positioning mechanism of the cantilevered umbrella in an embodiment of the utility model. The fixing teeth are meshed with the positioning rack.
Figure 15:
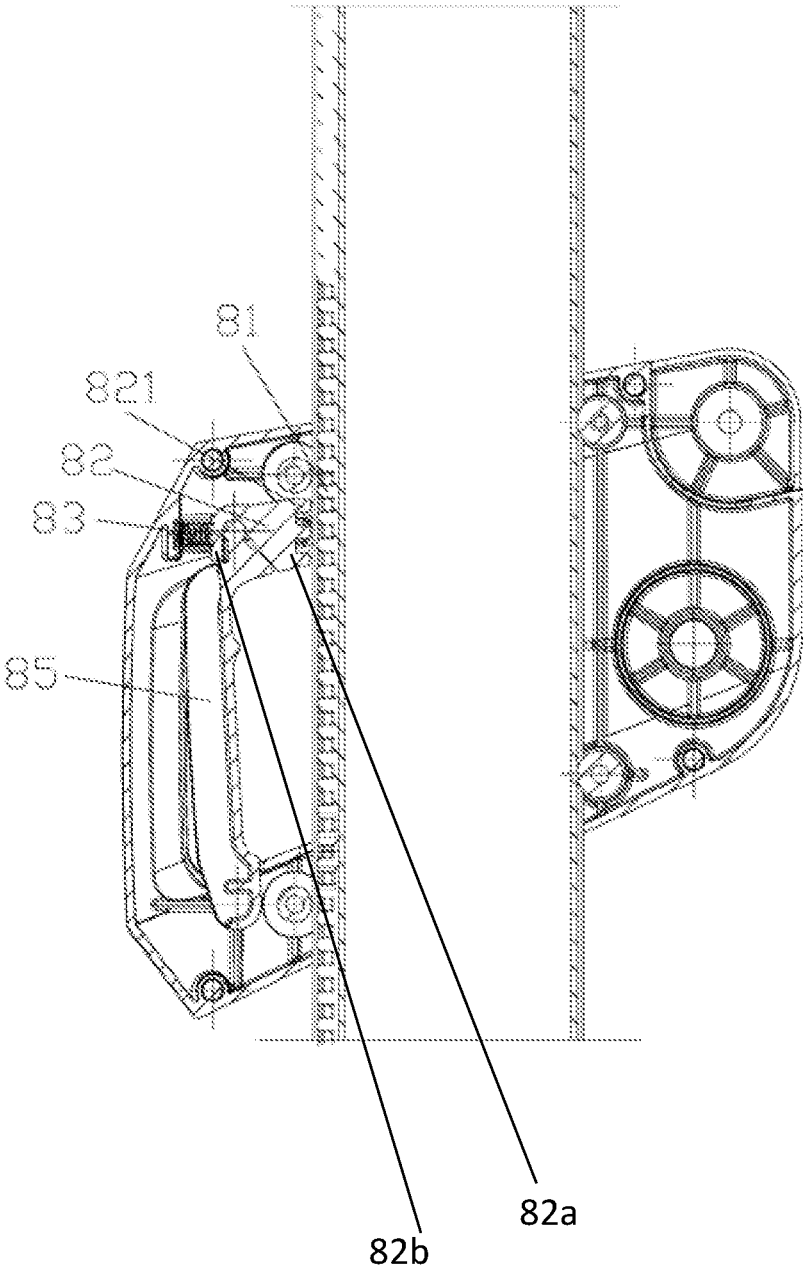
FIG. 15 is the assembly diagram of sliding block positioning mechanism of the cantilevered umbrella in an embodiment of the utility model. The fixing teeth are separated with the positioning rack.

The sliding block positioning mechanism 8 also comprises an elastic reset part 83 connected with the sliding block shell 21 and other end 82*b* of the positioning block 82, so that the positioning block 82 can move toward the positioning rack 81. As shown in FIG. 14, the fixing tooth 821 and the positioning rack 81 are meshed mutually in the initial position; the handle 85 rotates when being pressed and drives the fixing tooth 821 to move away from the positioning rack, the elastic reset part 83 is compressed (as shown in FIG. 15), and the position of the sliding block shell 21 can be adjusted. After releasing the handle 85, the action of the elastic reset part 83 drives the positioning block 82 to move toward the positioning rack 81. The fixing tooth 821 is meshed with the positioning rack 81 again (as shown in FIG. 14), so as to fix the connection structure with the sliding block shell 21. The elastic reset part 83 can realize automatic reset of the positioning block 82, and the sliding block shell 21 can be fixed again for convenient use after the handle 85 is released.

Further, the elastic reset part 83 is a compression spring, with both ends pressing against the positioning block 82 and the sliding block shell 21, so that the positioning block 82 can move toward the positioning rack 81, and the fixing tooth 821 and the positioning rack 81 can be meshed firmly.

As shown in FIG. 13, guide convex block 822 is arranged on both sides of the positioning block 82. Guide groove 210 is formed in the sliding block shell 21 relative to the guide convex block 822. The guide convex block 822 is inserted into the guide groove 210 for sliding fit. Such design is favorable for limiting the movement direction of the positioning block 82, so that the fixing tooth 821 can align to the positioning rack 81 when the positioning block 82 gets close to the positioning rack 81, and the fixing position of the sliding block positioning mechanism 8 can be adjusted easily.

As shown in FIG. 12, the sliding block positioning mechanism 8 also comprises rollers 84 installed in the sliding block shell 21 in a rotating mode, also referred to as a rotating configuration, so as to realize rolling fit with the stand column 1 and adjust the installation position of the sliding block shell 21 on the stand column 1 conveniently. In one embodiment, four rollers 84, but not restricted to, are evenly distributed around the stand column 1.

A rotating boss 851 is arranged at one end of the handle 85 and installed on the sliding block shell 21 in a rotating mode, also referred to as a rotating configuration. The rotating boss 851 is simple in structure and convenient to use, not only fixing one end of the handle 85, but also realizing the rotation of the handle 85.

In one embodiment, a columnar bulge is arranged at one end 85*a* of the handle 85. The positioning block 82 is provided with a groove 825, and a columnar bulge 852 is inserted in the assembly groove 825 to connect with the positioning block 82. The embodiment is simple in structure, easy to assemble and very convenient just by inserting the columnar bulge 852 of the handle 85 into the assembly groove 825 of the positioning block 82. In other embodiments, but not restricted to, the other end 85*b* end of the handle 85 can be connected with the positioning block 82 through pins or rivets, so as to facilitate use.

Further, the fixing tooth 821 are square teeth, and the tooth form of the positioning rack 81 adapts to that of the fixing tooth 821. Due to the large contacting area of the square teeth, the stress points are concentrated in a one point, so that the sliding block shell 21 can be fixed in a certain position of the stand column 1 stably.

The more the fixing tooth 821, the firm meshing between the fixing tooth 821 and the positioning rack 81. That is, the more stable the sliding block shell 21 fixing on the stand column 1, the stronger bearing capacity of the umbrella tent 4 installed on the cantilever 3. Preferentially, the number of the fixing tooth 821 is three, but not restricted to, two or four or five, which is not limited in the utility model. The utility model can limit the umbrella tent from rotating to a large elevation through the positioning part 5, so as to avoid tilting under the large external force. In addition, the positioning part 5 is simple in structure, convenient to install, firm and favorable for prolonging the service life of the umbrella.

The above mentioned is only a preferred embodiment of the utility model, which does not limit the patent scope of the utility model. The equivalent structure transformation made by using the specification and attached FIGS. Of the utility model, or directly or indirectly used in other related technical fields, is similarly included in the protection scope of the utility model.

FIGURE LABELS

1. Stand column;
2. Shell;
3. Cantilever;
4. Umbrella tent;
5. Positioning part;
6. Positioning display part;
8. Sliding block positioning mechanism;
13. Slanting rod;
21. Sliding block shell;
22. Cantilever shell;
51. Second positioning portion;

52. Flanges;
61. First positioning display block;
62. Second positioning display block;
71. Open-close rotating wheel;
73. Worm;
74. Worm gear;
75. Jiggle bar;
81. Positioning rack;
82. Positioning block;
83. Elastic reset part;
84. Roller;
85. Handle;
201. First positioning portion;
210. Guide groove;
211. First sliding block shell;
212. Second sliding block shell;
220. Indication identification;
510. Bolt hole;
821. Fixing tooth;
822. Guide convex block;
825. Assembly groove;
851. Rotating boss; and
852. Columnar bulge.

I claim:

1. A cantilevered umbrella, comprising:
a stand column;
an umbrella tent;
a cantilever, wherein one end of the cantilever is connected to the stand column through a shell in a rotating configuration, and another end of the cantilever is connected to the umbrella tent, wherein rotation of the cantilever is configured to drive the umbrella tent to rotate, with an opening of the umbrella tent rotating to a certain angle in a relatively horizontal direction; and
a positioning part, wherein one end of the positioning part is connected to the cantilever in a fixed configuration, and another end of the positioning part extends into the shell, wherein a first positioning portion is arranged on an inner wall of the shell, wherein a second positioning portion is arranged on the positioning part, wherein the first positioning portion and the second positioning portion limit the cantilever in a circumferential rotating range through coordination, wherein the first positioning portion is a positioning groove formed circumferentially along the inner wall of the shell, wherein an end portion of the second positioning portion is inserted in the positioning groove, wherein a movement range of the second positioning portion is limited between the both ends of the positioning groove, and wherein the second positioning portion comprises a positioning bolt penetrating through the positioning part.

2. The cantilever umbrella of claim 1, wherein the second positioning portion comprises a positioning bulge formed on the surface of the positioning part.

3. A cantilevered umbrella, comprising:
a stand column;
an umbrella tent;
a cantilever, wherein one end of the cantilever is connected to the stand column through a shell in a rotating configuration, and another end of the cantilever is connected to the umbrella tent, wherein rotation of the cantilever is configured to drive the umbrella tent to rotate, with an opening of the umbrella tent rotating to a certain angle in a relatively horizontal direction; and
a positioning part, wherein one end of the positioning part is connected to the cantilever in a fixed configuration, and another end of the positioning part extends into the shell, wherein a first positioning portion is arranged on an inner wall of the shell, wherein a second positioning portion is arranged on the positioning part, wherein the first positioning portion and the second positioning portion limit the cantilever in a circumferential rotating range through coordination, wherein the first positioning portion comprises at least two positioning bosses arranged circumferentially along the inner wall of the shell, wherein the at least two positioning bosses form a limit space, wherein an end portion of the second positioning portion is inserted in the limit space, wherein a movement range of the second positioning portion is limited between the two adjacent positioning bosses, and wherein the second positioning portion comprises a positioning bolt penetrating through the positioning part.

4. The cantilever umbrella of claim 3, wherein the second positioning portion comprises a positioning bulge formed on the surface of the positioning part.

5. A cantilevered umbrella, comprising:
a stand column;
an umbrella tent;
a cantilever, wherein one end of the cantilever is connected to the stand column through a shell in a rotating configuration, and another end of the cantilever is connected to the umbrella tent, wherein rotation of the cantilever is configured to drive the umbrella tent to rotate, with an opening of the umbrella tent rotating to a certain angle in a relatively horizontal direction;
a positioning part, wherein one end of the positioning part is connected to the cantilever in a fixed configuration, and another end of the positioning part extends into the shell, wherein a first positioning portion is arranged on an inner wall of the shell, wherein a second positioning portion is arranged on the positioning part, wherein the first positioning portion and the second positioning portion limit the cantilever in a circumferential rotating range through coordination, wherein the first positioning portion is a positioning groove formed circumferentially along the inner wall of the shell, wherein an end portion of the second positioning portion is inserted in the positioning groove, wherein a movement range of the second positioning portion is limited between the both ends of the positioning groove, and
a positioning display part fixed at one end of the cantilever, wherein one end of the positioning display part extends from a cantilever shell, and another end of the positioning display part extends into the cantilever shell, wherein a first positioning display block is arranged at the one end of the positioning display part and exposed from the cantilever shell, and wherein two second positioning display blocks are arranged at an end portion of the cantilever shell with an interval between the display blocks.

6. The cantilever umbrella of claim 5, wherein the first positioning display block is located between the two second positioning display blocks, wherein the first positioning display block moves with a range same as a movable range of the second positioning portion in the cantilever shell, wherein on rotation of the cantilever, the second positioning portion moves in the cantilever shell and the first positioning display block moves between the two second positioning display blocks, and wherein the movement position of the second positioning portion in the cantilever shell is judged according to the movement position of the first positioning display block.

7. A cantilevered umbrella, comprising:

a stand column;

an umbrella tent;

a cantilever, wherein one end of the cantilever is connected to the stand column through a shell in a rotating configuration, and another end of the cantilever is connected to the umbrella tent, wherein rotation of the cantilever is configured to drive the umbrella tent to rotate, with an opening of the umbrella tent rotating to a certain angle in a relatively horizontal direction; and a positioning part, wherein one end of the positioning part is connected to the cantilever in a fixed configuration, and another end of the positioning part extends into the shell, wherein a first positioning portion is arranged on an inner wall of the shell, wherein a second positioning portion is arranged on the positioning part, wherein the first positioning portion and the second positioning portion limit the cantilever in a circumferential rotating range through coordination, and wherein the positioning part is provided with a plurality of flanges to connect to the cantilever through rivets in a fixed mode.

8. A cantilevered umbrella, comprising:

a stand column;

an umbrella tent;

a cantilever, wherein one end of the cantilever is connected to the stand column through a shell in a rotating configuration, and another end of the cantilever is connected to the umbrella tent, wherein rotation of the cantilever is configured to drive the umbrella tent to rotate, with an opening of the umbrella tent rotating to a certain angle in a relatively horizontal direction;

a positioning part, wherein one end of the positioning part is connected to the cantilever in a fixed configuration, and another end of the positioning part extends into the shell, wherein a first positioning portion is arranged on an inner wall of the shell, wherein a second positioning portion is arranged on the positioning part, wherein the first positioning portion and the second positioning portion limit the cantilever in a circumferential rotating range through coordination, wherein the shell comprises a sliding block shell and a cantilever shell, wherein the sliding block shell is arranged on the stand column in a sliding configuration, wherein the cantilever shell is installed at one end of the sliding block shell in a pivoted configuration, wherein the first positioning portion is arranged on the cantilever shell, and the positioning part is installed in the cantilever shell, wherein an outer surface of the cantilever shell comprises an indication identification indicating a rotating direction of the opening of the umbrella tent, and wherein the indication identification comprises indication arrows and/or words indicating a user to rotate a jiggle bar to the direction that the opening of the umbrella tent should face toward.

9. The cantilever umbrella of claim 8, further comprising:

a sliding block positioning mechanism arranged in the sliding block shell, wherein the sliding block positioning mechanism is used for fixing the sliding block shell in one or more positions of the stand column and comprises a positioning rack, a positioning block and a handle, wherein the positioning rack is arranged on one side of the stand column, wherein the positioning block is installed in the sliding block shell in a movable configuration in the direction near or far away from the positioning rack, wherein one end of the handle is installed in the sliding block shell in a rotating configuration and another end of the handle is connected to the positioning block to drive the positioning block for movement, wherein the positioning block further comprises fixing teeth arranged at one end of the positioning block, facing toward the positioning rack and meshed with a contacting surface of positioning rack to fix the positioning block, wherein a number of the fixing teeth is more than two, and wherein the sliding block positioning mechanism further comprises an elastic reset part connected to the shell and the positioning block to move the positioning block towards the positioning rack.

* * * * *